United States Patent [19]

Hudson, Jr.

[11] Patent Number: 4,995,346

[45] Date of Patent: Feb. 26, 1991

[54] OIL JET PISTON COOLER

[75] Inventor: Sharon J. Hudson, Jr., Lambertville, Mich.

[73] Assignee: Sharon Manufacturing Company, Lambertville, Mich.

[21] Appl. No.: 372,322

[22] Filed: Jun. 28, 1989

[51] Int. Cl.[5] ..... F01P 1/04

[52] U.S. Cl. ..... 123/41.35; 239/570

[58] Field of Search ..... 123/41.34, 41.35, 41.42, 123/196 M; 184/6.26, 6.8; 239/570, 589, 590, 600

[56] References Cited

U.S. PATENT DOCUMENTS 2,800,119 7/1957 Schmidl ..... 123/41.35

3,709,109 1/1973 Howe ..... 123/41.35

FOREIGN PATENT DOCUMENTS 59-49719 4/1984 Japan ..... 123/41.35

*Primary Examiner*—Noah P. Kamen

*Attorney, Agent, or Firm*—Harold F. Mensing

[57] ABSTRACT

An oil jet piston cooling device which directs a stream of oil against the inside of a piston of an internal combustion engine. It comprises a hollow body member and an arcuate tubular spout member. The body member is a stepped hollow cylindrical member with an internally valved inlet opening on its smaller diameter upstream end. The smaller diameter body section defines a first portion of an entrance chamber. A second portion of the entrance chamber is defined by a coaxially disposed cylindrical upstream end section of the tubular spout member, which end section is fitted tightly inside the larger diameter section of the body member. The cross sectional area of the interior of each section of the device is equal to or greater than the cross sectional area of each succeeding section taken from inlet to outlet and the passageway is streamlined to reduce tuburlence. The device is designed to have its body end inserted into a bore that communicates with an oil artery on the pressure side of the bearing lubricating oil circulation system of the engine.

15 Claims, 1 Drawing Sheet

OIL JET PISTON COOLER

BACKGROUND OF THE INVENTION

FIELD OF THE INVENTION

This invention relates to a device for directing a relatively solid stream of engine lubricating oil against the inside of a piston of an internal combustion engine.

Similar devices have been used in the past but they were generally made of an excessive number of parts which were expensive to manufacture and difficult to assemble. Another problem that existed with similar prior art devices was the unnecessarily high pressure drop caused by restrictive features inherent in their construction. The excessive pressure drop was counterproductive in two respects. First of all, it consumed energy needlessly without any commensurate benefit. Secondly, it tended to cause the projected jet stream to become dispersed rather than remain cohesive or solid. An essentially solid stream appears to be the most effective means for cooling the piston.

PROBLEMS SOLVED

The various elements disclosed herein, including their relative sizes and shapes, cooperate to provide an oil jet type piston cooler that has a minimum pressure drop as the oil travels from its inlet end to its outlet end.

In addition to being efficient, the device is economical to manufacture and assemble. It is constructed of a minimum number of simple light weight parts that can be fitted together easily by automated equipment.

Furthermore, this oil jet piston cooler is easy to install and can be adapted readily for use on a variety of engines without physically modifying the separate parts.

SUMMARY OF THE INVENTION

The oil jet piston cooling device of this invention is designed to direct a relatively solid stream of oil against the inside of a piston of an internal combustion engine. Basically, it comprises a body member and a spout member. The body member is designed to be fitted into a bore in the engine block which communicates with an oil artery on the pressure side of the bearing lubricating oil circulation system and supplies oil under pressure to the inlet end of the device. This body member defines a portion of an entrance chamber which houses a pressure responsive valve mechanism that covers the inside of an inlet opening on its upstream end. The spout member is bent into a reentrant curve along X, Y and Z axes such that the axis of its exit nozzle end is laterally offset from and disposed at an angle of approximately 360 degrees relative to the axis of the upstream end. The upstream end of the spout member is positioned coaxially inside the downstream end of the body member and forms the remaining portion of the entrance chamber. Preferably, the edge of its upstream end is in the shadow of an annular shoulder on the down stream end of the first section of the entrance chamber. Turbulence and pressure drop are minimized by streamlining the interior and sizing the diameters of the various sections such that the largest internal diameter is at the entrance end and the succeeding diameters are progressively smaller.

The details and advantages of the invention will be understood best if the written description is read with reference to the accompanying drawings.

DETAILED DESCRIPTION OF A PREFERRED EMBODIMENT

Figure 1:
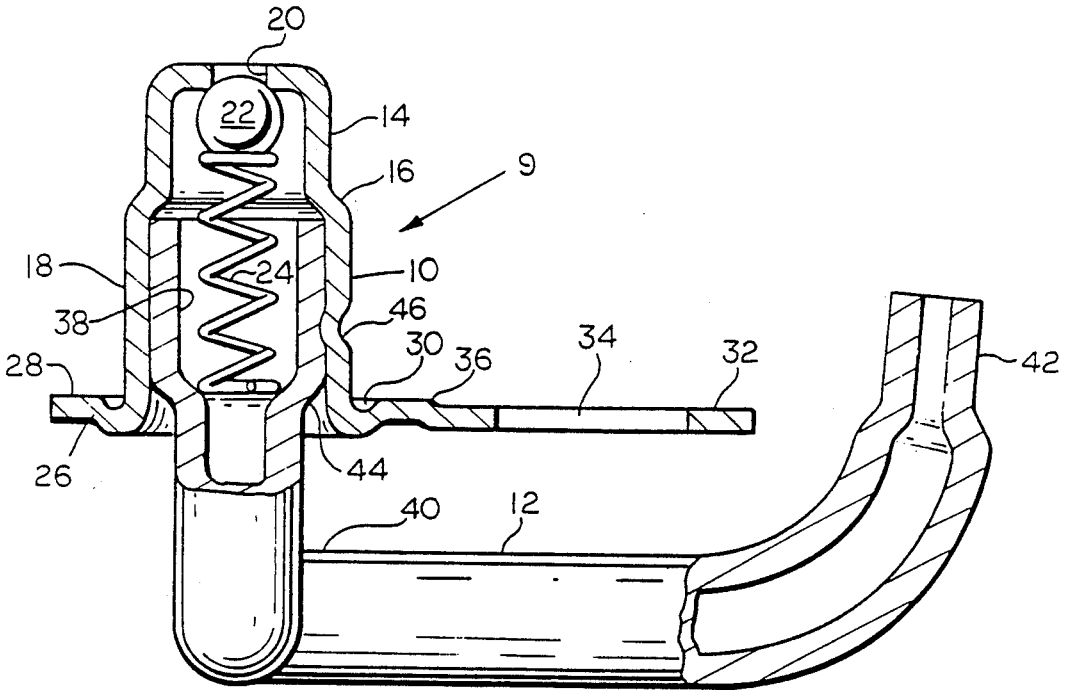
FIG. 1 is a partially sectioned side view of the oil jet piston cooler assembly of this invention.
Figure 2:
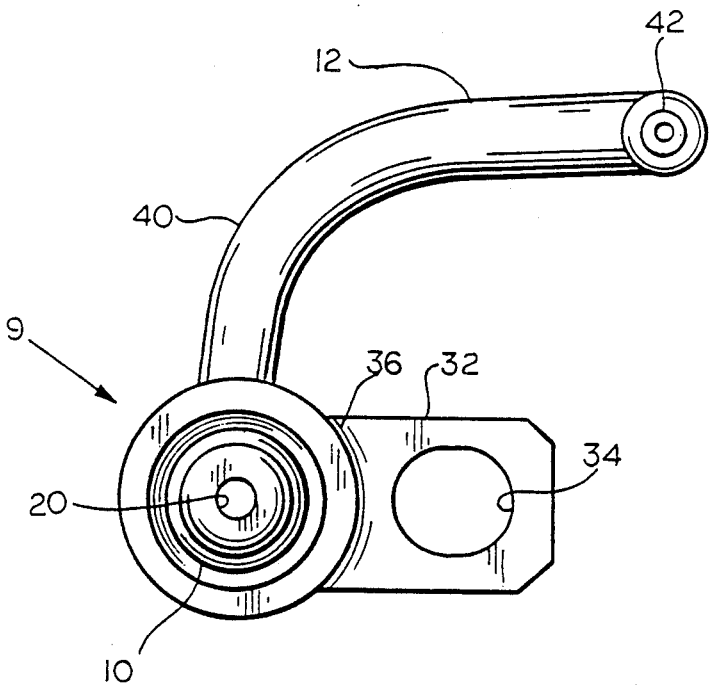
FIG. 2 is a plan view of the assembly shown in FIG. 1 on a reduced scale.

Referring to the drawings, it will be noted that the oil jet piston cooling device assembly is comprised of a body member 10 and a spout member 12. Body member 10 has a first cylindrical section 14 disposed upstream from and integrally attached by an annular transition shoulder 16 to a coaxially aligned second cylindrical section 18 of larger diameter. The smaller diameter first body section functions as a pilot to ease the entry of the body member into its engine block bore. Its inside walls define a first portion of an entrance chamber. An internally valved inlet opening 20 is provided on the upstream end of the first body section. Preferably, the surface surrounding the inlet on the entrance chamber side of the opening is provided with a smooth work hardened precisely formed valve seat produced by coining the valve seat area. This can be readily performed automatically on a stamping machine as one of the steps in progressively forming process. A pressure responsive valve mechanism is housed in the entrance chamber. It may simply comprise a spherical ball check element 22 and a coaxially disposed helical spring 24.

An annular mounting flange 26 extends laterally outward from the periphery of the downstream end of the second or larger diameter body section. Preferably, the flange has a flat annular outer section 28 separated from the adjoining body section periphery by an intermediate section 30 in the form of a concentric annular groove which provides a recess on the inside corner of the juncture of the flange and body section. This recess allows the flat annular outer portion of the flange to be seated against a confronting surface of the engine block without any interference from any burrs that may have been turned up around the edge of the bore during the machining operation. A flat orienting strap section 32, having an oblong aperture 34 in its distal end, extends radially outward from a portion of the flange periphery. The strap may be provided with an offset 36, adjacent to its juncture with annular flange 26, to step it away from the plane of the flat section of the annular flange and thus produce a spring bias which tends to seat and hold the flat annular section against a corresponding planar section on the underside of the engine block when a fastener is inserted through aperture 34 into the engine block and driven home.

Spout member 12 has a cylindrical upstream end section 38 integrally connected to an arcuate tubular intermediate section 40 followed in turn by an elongated nozzle section 42 at its downstream end. The upstream end section 38 of the spout member is coaxially disposed and tightly fitted within second section 18 of the body member. It defines the second portion of the aforementioned entrance chamber and has an internal diameter which is less than that of the first portion of the entrance chamber. The first portion of the intermediate section 40 is likewise coaxially disposed and of lesser internal diameter than preceeding end section 38. A tapered annular shoulder 44, formed by the merger of the end section 38 with the intermediate section of the spout member, conveniently provides a self centering seat for the downstream end of the valve spring. The remaining portions of the intermediate section consist of a series of curved legs extending in various general directions. The first leg extends generally in a "Y" direction, the next leg in a "Z" direction and third or last leg in an "X" direction substantially parallel with the axis of the entrance chamber The nozzle section at the exit end of the spout member also extends in the "X" direction generally. It has a smaller internal diameter than that of the intermediate section which is substantially constant.

Assembly of the piston cooler device simply involves the insertion of the ball check element 22 and helical spring 24 into the open end of the body member 10 and axially advancing the upstream end 38 of the spout member 12 into the second section 18 of the body member until the leading or upstream end 38 of the spout member is brought into abutment with the inside surface of transition shoulder 16. Since the telescoped sections of the two members are cylindrical, they may be rotated relative to one another so as to move the nozzle section 42 translationally into its optimum cooling position. The most effective rotational position is dictated by extraneous parameters and may vary from one engine size or style to another and may even be different for various cylinders of the same engine. It is important to note that the specific configuration and arrangement dislosed here allows translational movement of the nozzle axis. These members may be held together permanently by one or more lock points 46 produced by a staking punch or other means.

Installation is accomplished by inserting the smaller diameter first cylindrical section 14 of the body member 10 axially into its respective bore in the engine block, aligning the fastener aperture in the strap with a corresponding hole in the engine block, pressing the larger diameter second section 18 of the body member into the bore until the flat section 28 of the annular flange 26 is seated against the confronting engine block surface and securing the device with an appropriate fastener such as a bolt or screw.

What is claimed is:

1. An improved oil jet piston cooling device for directing a stream of oil upwardly towards the inside of a reciprocable piston of an internal combustion engine, said device comprising: a body member having an upstream cylindrical end section defining a first upstream portion of an entrance chamber, said body member having a valve aperture and a surrounding seat on its upstream end, a spout member having an upstream cylindrical end section defining a second portion of said entrance chamber, said upstream end of said spout member being tightly fitted inside said body member and coaxially aligned with said upstream end of said body member, said spout member also having an intermediate section followed by a nozzle section on its downstream end, and a pressure responsive valve mechanism contained in said entrance chamber.

2. An improved oil jet piston cooling device according to claim 1: wherein said spout member is arcuate and the axis of its said upstream end is substantially parallel to the axis of its nozzle end.

3. An improved oil jet piston cooling device according to claim 1: wherein said device has an internal passageway defined by serially connected sections and the cross sectional area of each successive passageway section is less than that of the preceeding upstream section.

4. An improved oil jet piston cooling device according to claim 1: wherein said surrounding seat has a work hardened precisely formed surface produced by a coining operation.

5. An improved oil jet piston cooler comprising: an arcuate tubular spout having an upstream end section, an intermediate section and a nozzle end section, said upstream end section having a larger inner diameter than that of said intermediate section and being integrally connected thereto by an annular transition shoulder section, said nozzle end section having a smaller internal diameter than that of said intermediate section, a base member having a first cylindrical body section with an internally valved inlet aperture at one end, a second body section of larger diameter containing said upstream section of said spout member, said first and second body sections being coaxially disposed and integrally connected together by an annular shoulder, an annular mounting flange surrounding said body section and extending laterally outward from the periphery of the downstream end of said second body section, an orienting arm extending radially from said mounting flange, said orienting arm having an aperture for receiving a fastener, a pressure responsive valve mechanism disposed on the inside of said inlet aperture.

6. An improved oil jet piston cooling device according to claim 5: wherein the axis of said upstream end of said arcuate spout member is substantially parallel to the axis of the nozzle end of said spout member.

7. An improved oil jet cooling device according to claim 5: wherein said spout member has serially connected arcuate leg portions disposed along "X", "Y" and "Z" axes.

8. An improved oil jet piston cooling device according to claim 5: wherein each successive cross sectional area of the passageway defined by the serially connected sections of the device are less than that of the preceeding section.

9. An improved oil jet piston cooling device according to claim 5: wherein said upstream end of said spout member abuts the inside of said body member shoulder.

10. An improved oil jet piston cooling device according to claim 5: wherein said valved inlet aperture has a surrounding work hardened precisely formed valve seat surface produced by a coining operation.

11. An improved oil jet piston cooling device according to claim 5: wherein said inlet aperture has a surrounding valve seat and said pressure responsive valve mechanism includes a ball check element resiliently held against said seat by means of a coaxially disposed helical spring that has its downstream end positioned against said annular shoulder of said spout member.

12. An improved oil jet piston cooling device for directing a stream of oil upwardly towards the inside of a reciprocable piston of an internal combustion engine, said device comprising: a body member having an upstream cylindrical end section defining a first upstream portion of an entrance chamber, said body member having a valve aperture and a surrounding seat on its upstream end, a spout member having an upstream cylindrical end section defining a second portion of said entrance chamber, said cylindrical sections defining said entrance chamber being coaxially aligned, said spout member also having an intermediate section followed by a nozzle section on its downstream end, said intermediate section and said upstream cylindrical end section of said spout member have coaxially aligned adjacent ends, said intermediate section has a smaller diameter than that of said adjacent upstream end section, said intermediate and adjacent upstream spout sections are integrally connected together by an annular shoulder, and a pressure responsive valve mechanism contained in said entrance chamber.

13. An improved oil jet piston cooling device according to claim 12: wherein said pressure responsive valve mechanism includes a ball check element resiliently held against said seat by means of a coaxially disposed helical spring that has its downstream end positioned against said annular shoulder of said spout member.

14. An improved oil jet piston cooling device for directing a stream of oil upwardly towards the inside of a reciprocable piston of an internal combustion engine, said device comprising: a body member having an upstream cylindrical end section defining a first upstream portion of an entrance chamber, said body member having a valve aperture and a surrounding seat on its upstream end, a spout member having an upstream cylindrical end section defining a second portion of said entrance chamber, said cylindrical sections defining said entrance chamber being coaxially aligned, said spout member also having an intermediate section followed by a nozzle section on its downstream end, said spout member having serially connected arcuate leg portions disposed along "X", "Y" and "Z" axes with the axis of its upstream end substantially parallel to the axis of its nozzle end, and a pressure responsive valve mechanism contained in said entrance chamber.

15. An improved oil jet piston cooling device for directing a stream of oil upwardly towards the inside of a reciprocable piston of an internal combustion engine, said device comprising: a body member having an upstream cylindrical end section defining a first upstream portion of an entrance chamber, a coaxially disposed larger diameter cylindrical downstream end section which is coaxially disposed and integrally connected thereto by an annular transition shoulder said body member having a valve aperture and a surrounding seat on its upstream end, a spout member having an upstream cylindrical end section defining a second portion of said entrance chamber, said upstream end section of said spout member abuts the inside of said shoulder, said cylindrical sections defining said entrance chamber being coaxially aligned, said spout member also having an intermediate section followed by a nozzle section on its downstream end, and a pressure responsive valve mechanism contained in said entrance chamber.

* * * * *